US005351897A

United States Patent [19]

Martin

[11] Patent Number: 5,351,897

[45] Date of Patent: Oct. 4, 1994

[54] ADJUSTABLE ERGONOMIC SUPPORT FOR COMPUTER KEYBOARDS

[76] Inventor: Michael Martin, 117 W. End Ave., Somerville, N.J. 08876

[21] Appl. No.: 871,108

[22] Filed: Apr. 20, 1992

[51] Int. Cl.[5] ..... A47F 5/00

[52] U.S. Cl. ..... 244/118; 248/291; 248/918

[58] Field of Search ..... 248/918, 231, 291, 118.3, 248/118

[56] References Cited

U.S. PATENT DOCUMENTS 3,991,961 11/1976 Platzer ..... 248/291 X 4,706,919 11/1987 Soberalski et al. ..... 248/918 X 4,949,650 8/1990 Allard ..... 248/918 X

*Primary Examiner*—Douglas D. Watts

*Attorney, Agent, or Firm*—Clifford G. Frayne

[57] ABSTRACT

A keyboard support assembly for computer keyboards which allows for multiple adjustments by the operator in order to accommodate operators of different anatomical sizes, the keyboard being fully adjustable in height, and angular tilt and providing a palm support in order to obtain a neutral forearm and wrist position thereby eliminating wrist and forearm stress and decreasing the potential for carpal tunnel syndrome.

6 Claims, 5 Drawing Sheets

11
18
10
20
14
16
24
60
16
14
22
26
34
32
36
30
28
30
29
38
42
40

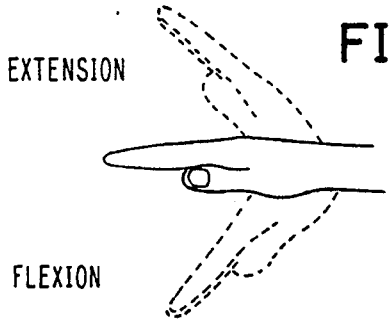
FIG. 5A
FIG. 5
FIG. 5B
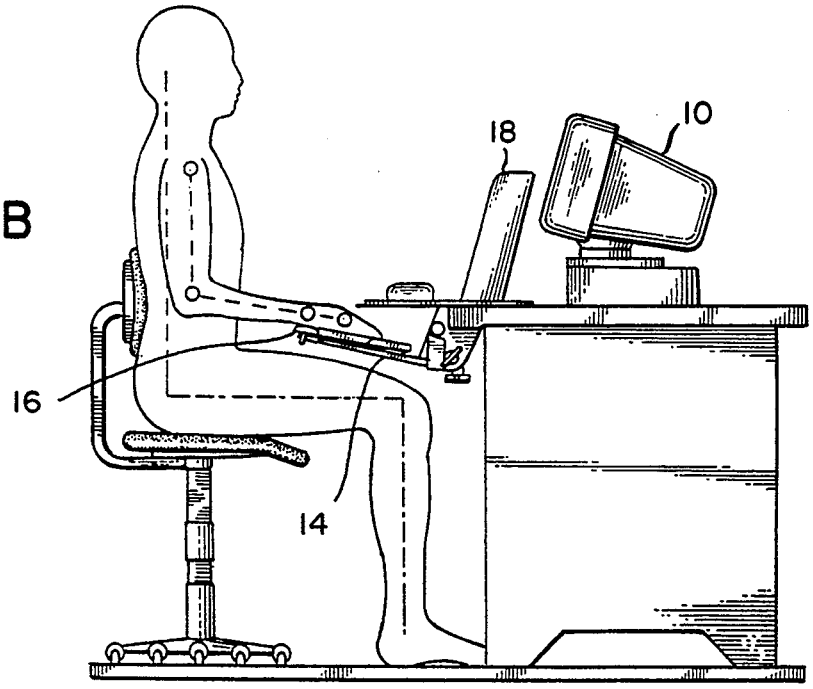
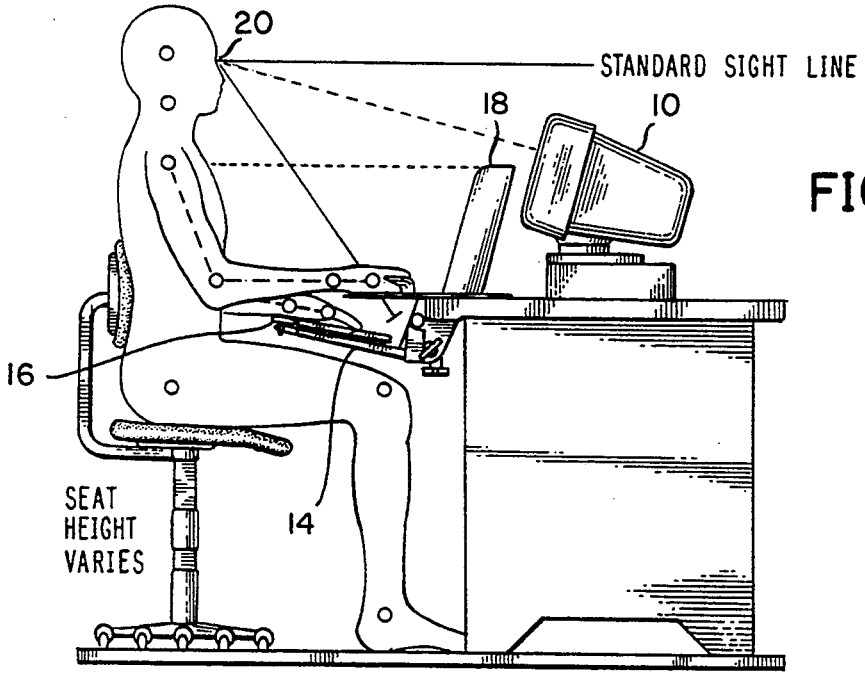
FIG. 5C

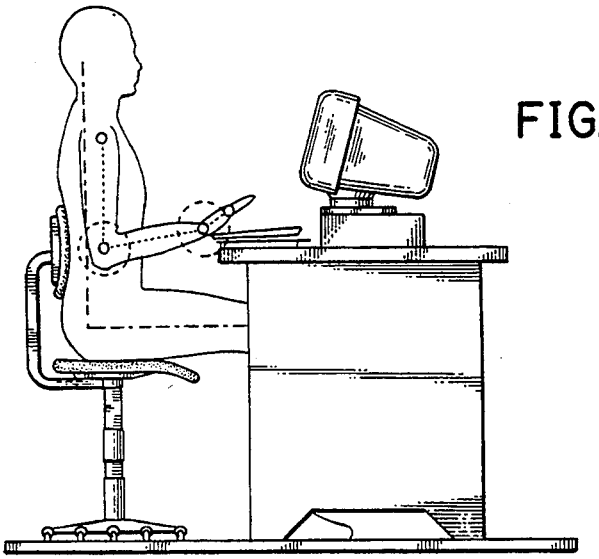
FIG. 6A
FIG. 6
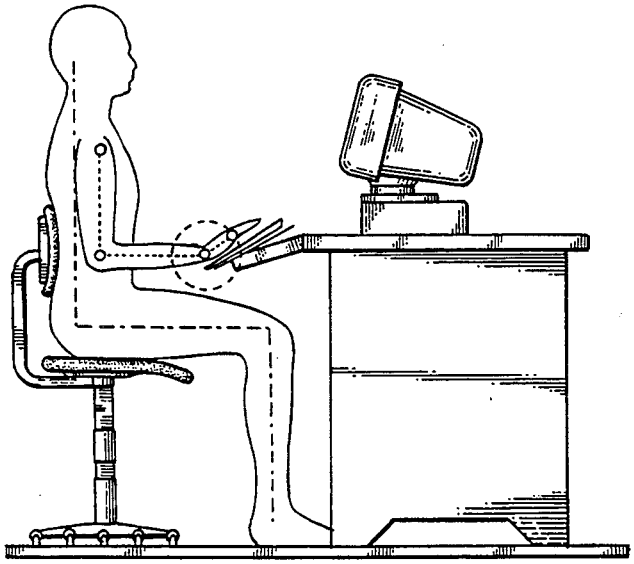
FIG. 6B
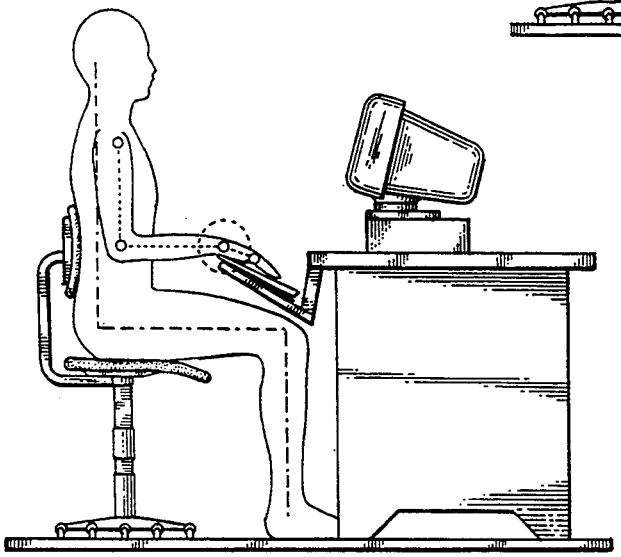
FIG. 6C

ADJUSTABLE ERGONOMIC SUPPORT FOR COMPUTER KEYBOARDS

BACKGROUND OF THE INVENTION

This invention relates to an improved adjustable support platform for support of a computer keyboard and ancillary computer aids, the support being fully adjustable for individuals of varying sizes, either right handed or left handed and providing an ergonomic environment for the operator.

The advent of the personal computer in the early 1980's resulted in a total revamping and change in the office environment. Data processing and word processing could now be accomplished at much greater speeds and efficiencies. The keyboard developed for use with personal computers evolve from the technology associated with manual typewriters which required a posture suited to a slower typing rate and heavy downward stroke on the keys. Further, the manual machines and even the later generation electric typewriters provided for frequent rest periods for the operator. Fingers could rest on the keys without causing them to actuate and rests were further provided by interruptions such as carriage returns, paper changes and manual error corrections. These short rests or mini breaks allow time for recovery from any fatigue, trauma or tension in the lower arms, wrist and fingers.

With the advent of the personal computer, office place injuries in the form of carpal tunnel syndrome has more than doubled. This trauma occurs when the nerve and tissues in the carpal tunnel within the wrist are compressed by the bones and ligaments. It results in numbness, tingling and pain in the hand and fingers that migrates to the elbow and shoulders. Corrective surgery to correct this malady is required in over 50% of the cases and in many instances must be repeated a second time within eighteen (18) months One culprit identified in the rise in carpal tunnel syndrome is the computer keyboard and its positioning vis-a-vis the posture of the operator The computer and the associated keyboard has eliminated the mini or micro breaks that the operator experienced in using manual machines or late model electric typewriters. There is no longer a carriage return. Paper changes are not required and manual error corrections are performed through further use of the keyboard. Feather-touch keys on the keyboards reduce the amount of force required to actuate the keys and mandate that the operator cannot rest their fingers on the keys. Productivity has increased dramatically as a result of the development of the personal computer. Typing speeds in the form of strokes per hour have quadrupled since all corrections and directions are now performed by keyboard functions with directions to the personal computer. However, the overall method of data entry has not significantly improved. Computer operators continue to assume a traditional typing position in which the wrists are flexed. This position is acceptable for manual typewriters where the mini breaks occur in the data entry process, but is not suitable for utilizing computer keyboards for data entry where the speed of data entry has been greatly increased.

There have been many attempts to develop a keyboard support which would combine several advantages for the keyboard operator. These developments include mounts which allow the keyboard support to be slid under the desk top, supports which allow the raising and lowering of the keyboard, and in some instances, attempts have been made to provide for the tilting of the keyboard. Examples of these developments can be found in the following U.S. Pat. Nos.: 5,037,054, 5,040,760, 5,031,867, 4,988,066, 4,913,390, 4,826,123, 4,776,284, 4,706,919, 4,691,888, 4,635,893 and 4,616,798.

None of the above-identified patents address the key issue with respect to the positional relationship of the keyboard in both horizontal and vertical planes to the relationship of the positioning of the operator's forearms, wrist and fingers.

Applicant's apparatus is an ergonomically-designed support for the keyboard and other related computer aids including document holders which position the operator's forearms, wrist and fingers in a neutral position with the keyboard supported in a slightly tilted, non-horizontal plane, the rear of the keyboard being lower than the front of the keyboard thereby eliminating any flexation or extension in the forearms, wrist and fingers of the operator.

OBJECT OF THE INVENTION

An object of the present invention is to provide for a novel computer workstation adaptable to different size operators.

Another object of the present invention is to provide for a novel workstation which is adaptable to different size operators who are either predominantly right handed or left handed.

A further object of the present invention is to provide for a novel computer workstation in which the keyboard is adjustable with relationship to the operator in both height and angular tilt.

A still further object of the present invention is to provide for a novel computer workstation in which the keyboard support is adjustable in angular tilt to eliminate flexion and tension in the operator's wrist and forearms and permit the operator to maintain his arms and wrists in a neutral position during operation.

A still further object of the present invention is to provide for a novel computer workstation combining an ergonomically-designed keyboard support, together with ergonomically-positioned computer aids including a mouse pad, writing surface and document holder.

A still further object of the present invention is to provide for a novel computer workstation in which the operator is provided with an adjustable palm rest adjacent the computer keyboard support to allow adjustment of the positioning of the operator's arms and wrists to a neutral position.

A still further object of the present invention is to provide for a novel computer workstation which allows the operator to adjust the workstation to obtain a comfortable and correct posture position suitable to the operator's anatomy.

A still further object of the present invention is to provide for a novel computer workstation which provides a keyboard support adjustable in both height and angular tilt so as to eliminate or substantially lessen the possibility of the development of carpal tunnel syndrome by the operator.

A still further object of the present invention is to restrict the trickle of ESD (electrostatic discharge), ELF (extremely low fields) and VLF (very low fields) discharges from the body and funnel them through the palm rest which contains the carbon impregnation conductor.

SUMMARY OF THE INVENTION

The present invention is directed towards a keyboard positioning system either alone or in combination with other computer aids such as a document holder, mouse pad and writing surface which is ergonomic in design and allows for multiple adjustments by the operator in order to accommodate operators of different anatomical sizes, the keyboard support being fully adjustable in height, and angular tilt, the keyboard support having a fully-adjustable palm support to allow the operator to adjust the positioning of the keyboard in order to obtain a neutral forearm and wrist position and thereby eliminate the stress which often times leads to carpal tunnel syndrome. The keyboard positioning system is available in a single embodiment or in conjunction with computer aids such as a mouse pad, writing surface and document holder which are similarly ergonomically designed and adjustable for the comfort of the operator.

BRIEF DESCRIPTION OF THE DRAWINGS

The character of the present invention, together with the objects of the invention may best be understood by reference to the accompanying drawings which illustrate the structural and functional aspects of the invention and in which:

FIGS. 5, 5A, 5B, 5C and 6, 6A, 6B, 6C are comparative illustrations of the subject keyboard support and positioning system and the prior art.

DETAILED DESCRIPTION OF THE DRAWINGS

Figures 1, 2:
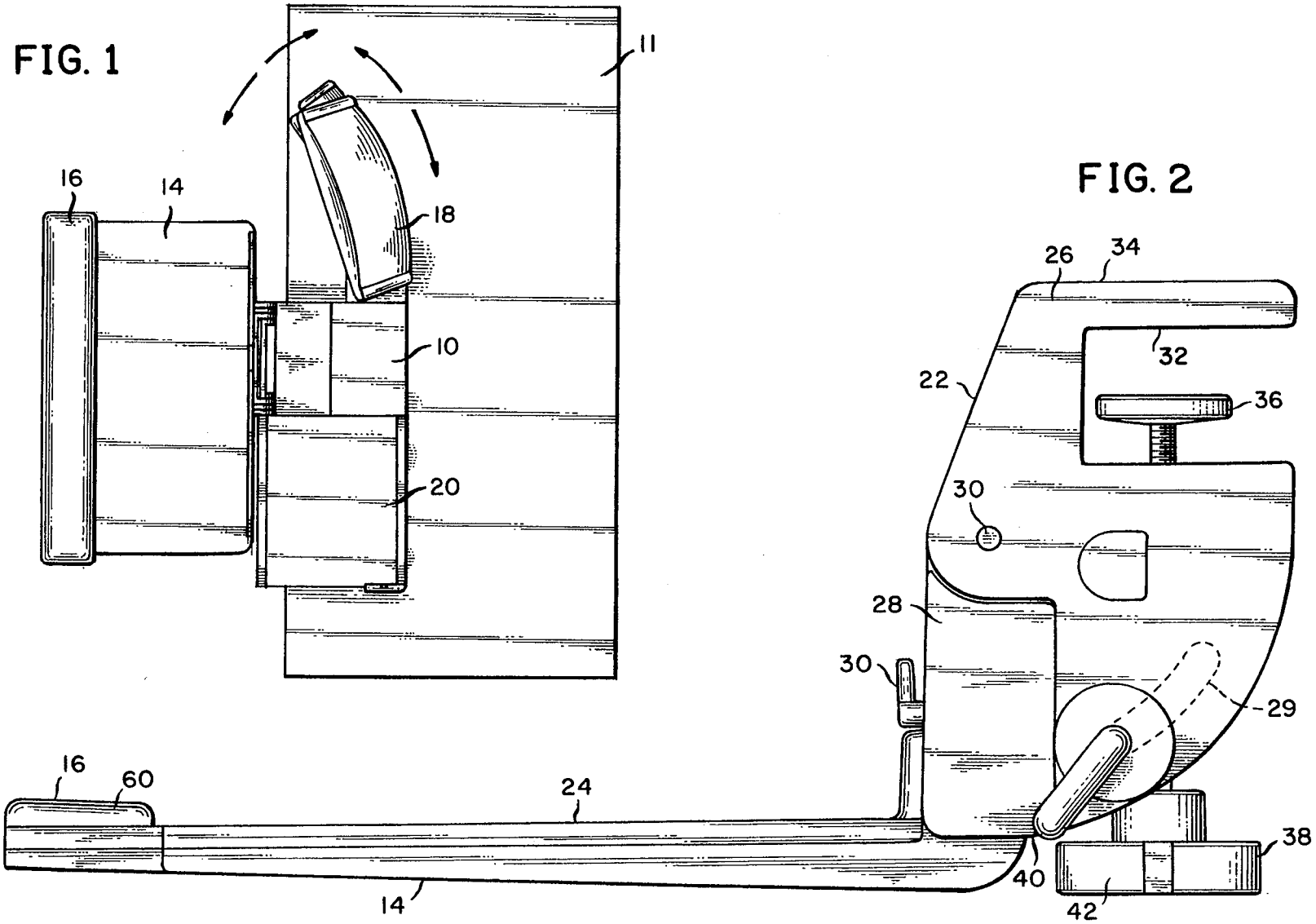
FIG. 1 is a top view of the keyboard support and positioning system in conjunction with ancillary computer aids.
FIG. 2 is a side view of the keyboard support.

FIG. 1 is a top view illustrating the relationship of the various elements of the keyboard positioning system. A computer monitor 10 is positioned on a computer table or desk surface 12. Computer monitor 10 is in communication with a central processing unit (not shown) which may be located in close proximity to the monitor or at a remote location. The operator would normally be located in a seated position facing the monitor. Applicant's keyboard positioning system positions a keyboard support platform 14 and palm rest 16 between the operator and the monitor 10. The structure of keyboard support platform 14 and palm rest 16 will be more fully understood with detailed reference to FIGS. 2 and 3 which are addressed hereafter.

In performing data entry or word processing or calculation functions, the operator is oftentimes transferring data or text from previously-generated documents and there is therefore a need to provide a document holder 18 so as to position documents in an easy-to-read location vis-a-vis monitor 10 and the operator so as to facilitate the entry of the data. Additionally, the operator may have software which permits or requires the use of a mouse in order to selectively transfer data through visual commands provided by the mouse on the monitor screen. Hence, a mouse pad 20 is located in proximity to the video monitor 10. Document holder 18 and mouse pad 20 are designed to be selectively exchanged with each other from the right-hand side to the left-hand side to the computer monitor depending upon the preferred manual dexterity of the operator. When not used in conjunction with a mouse, mouse pad 20 provides a writing surface for the operator.

Keyboard support platform 14 is adjustable in height relative to the operator and the computer monitor 10 and is adjustable in angular tilt with respect to the operator. These adjustable characteristics of keyboard support platform 14 are more fully understood with reference to FIGS. 2 and 3.

FIG. 2 is a side elevational view of a first embodiment of keyboard support platform 14. Three main elements comprise keyboard support platform 14, first, a bracket assembly 22 for securing keyboard support platform 14 to a desk or table support surface 12; a keyboard support surface 24 securable to bracket 22 and angularly pivotal about a pivot point 30 on bracket assembly 22, support surface 24 being generally rectangular in nature having an area and dimension substantially equal to that of a standard computer keyboard: and finally, palm rest 16 which is secured to the lateral edge of keyboard support platform 14 opposite bracket 22.

Bracket assembly 22 is centrally positioned with respect to keyboard support platform 14. Bracket assembly 22 is comprised of a stationary member 26 and a movable member 28 which pivots with respect to stationary member 26 about pivot point 30. Stationary member 26 has a generally-rectangular receiving slot 32 positioned proximate to its upper edge 34. Receiving slot 32 is designed to receive and engage the edge of a computer workstand or table top. Stationary member 26 would be secured to the computer worktable or desk top by means of a friction fastener 36 secured to an operable thumb screw 38 positioned at the lower end 40 of bracket assembly 22. Fastening member 36 is rotatably movable along its vertical axis within rectangular slot 32 by means of thumbscrew 38 in order to frictionally engage the underside of the computer workstand or table, the upper surface of the workstand or table being engaged by the interior upper surface of rectangular slot 32.

The width of stationary bracket member 26 is of such dimension in order to provide a stable and secure frictional engagement with the computer workstand or table top when fastening member 36 is firmly secured to the underside thereof. Preferably, in operation, stationary member 26 of bracket assembly 22 would be positioned on the computer workstand or table top and centered on the computer monitor.

Movable member 28 of bracket assembly 22 which pivots about pivot point 30 has an arcuate channel 29 positioned therein for engagement with tilt lever control 42. Tilt lever control 42 comprises a shaft passing through stationary member 26 and movable member 28 of bracket assembly 22. The shaft member and arcuate slot in movable member 28 cooperate to permit keyboard support platform 14 to be rotated about pivot point 30 in order to achieve a desired degree of angular tilt. Preferably, tilt lever control 42 is engageable from a locked to an unlocked position by means of lever 42 in conjunction with a concentric sleeve mounted on its shaft to engage the arcuate slot 29, within movable member 28. This allows the operator to disengage the tilt lever control 42 from a locked position, adjust the angle of tilt of keyboard support surface 24 and then to reenage the locking mechanism of tilt control lever 42, and its associated shaft with the arcuate channel 20 within movable member 28.

A centrally-positioned height adjustment knob 50 cooperative with movable member 28 and keyboard support platform 14 permits the raising and lowering of keyboard support surface 24 so as to adjust for the proper height of the operator when in a sitting position. Height adjustment knob 50 is more readily discernable with reference to FIG. 3 discussed hereafter.

Palm rest 16 is located on the opposite side of keyboard support surface 24 from bracket assembly 22. Palm rest 16 has an upper surface 60 that the operator's wrist and lower palm would rest during operation. The surface is generally smooth to permit easy movement of the hands and broad enough and contoured enough to eliminate any pinch or pressure points that would restrict circulation or compress nerve tissue. In the preferred embodiment, surface 60 of palm rest 16 would be made of plastic or another suitable material that is purposely a poor conductor of heat such that it will not draw heat from the operator causing discomfort. It would further restrict electrostatic discharge, extremely low field and very low field discharges from the body.

Figure 3:
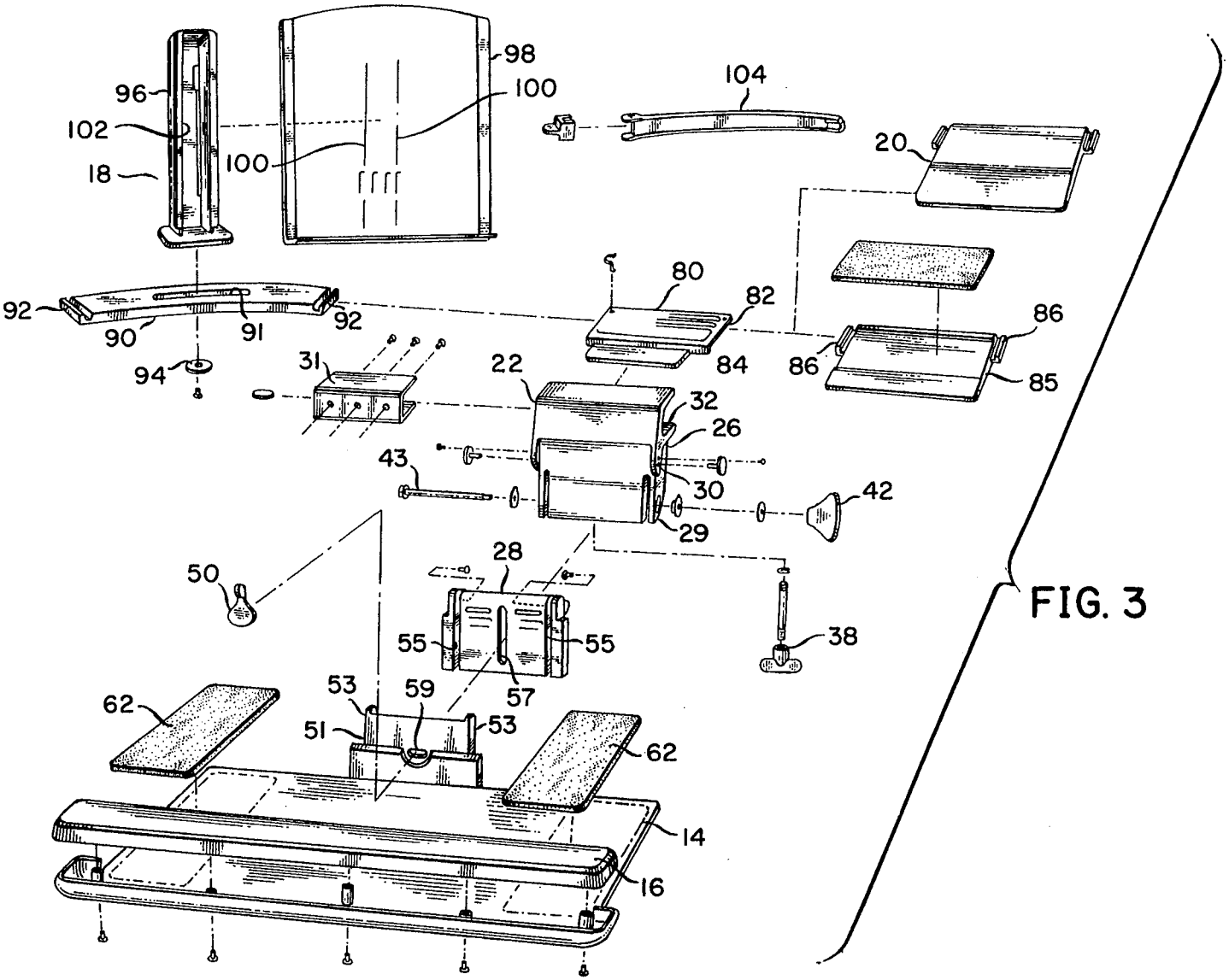
FIG. 3 is an exploded perspective view of the keyboard support apparatus.

FIG. 3 is a front exploded view in partial perspective of the keyboard support apparatus and ancillary utilities which will aid in understanding the cooperative characteristics of the structural elements. Stationary member 26 of bracket assembly 22, having a generally U-shaped receiving slot 32 would be positioned in securable relationship with a desk or table top 12 (not shown). Thumb screw 38 in cooperation with friction fastener 36 (not shown) would secure stationary member 26 to the table or desk top. Stationary member 26 may include a reinforcing sleeve 31 which conforms to the shape of U-shaped receiving slot 32 and which would be secured therein. Reinforcing sleeve 31 would provide additional strength to receiving slot 32 in light of the weight which it would support and to ensure a secure fit with the table or desk top.

Movable member 28 of bracket assembly 22 is secured in pivotal relationship with stationary member 26 by means of tilt control lever 42 secured to a pivot bolt 43 passing through stationary member 26 and movable member 28. In this fashion, turning tilt control lever 42 in one direction would release the compression engagement between stationary member 26 and movable member 28 and allow the user to angularly adjust keyboard support platform 24 about pivot point 30 by maneuvering pivot bolt 33 in guided relationship with arcuate channel 29 until the desired degree of angularity or tilt had been achieved. Tilt control lever 42 would then be rotated in the opposite direction to reachieve the compression engagement and fix the relative relationship between stationary member 26 and movable member 28.

Support platform 14 is slidably secured on movable member 28 by means of a height adjustment knob 50 and a front mounting plate 51. Front mounting plate 51 has lateral vertical ribs 53 which are engageable with lateral vertical receiving slots 55 in movable member 28. Movable member 28 has a centrally-disposed vertical slot 57 in alignment with a centrally-disposed aperture 59 on front mounting plate 51. In this arrangement, height adjustment knob 50 having a threaded bolt extension, passes through aperture 59 and receiving slot 57 in movable member 28 and is secured by a shoulder bolt. This permits the rotation of adjustment knob 50 to release compression between front mounting plate 51 and movable member 28 and allows keyboard support platform 14 to be moved in a vertical plane to obtain the optimum height adjustment for the user. Adjustment knob 50 is then rotated in the reverse direction to reenage the compression engagement between movable member 28 and front mounting plate 51. The cooperation between vertical lateral ribs 53 and receiving slots 55 aid in maintaining the alignment of keyboard support platform 14 and further aid in supporting and guiding keyboard support platform 14 when height adjustment is required. Keyboard support platform 14 and its support surface 24 can thereby be selectively positioned to accommodate the physiological parameters of the user.

Support surface 24 can thereby be selectively positioned to accommodate the physiological parameters of the user. Additionally, support surface 24 may have positioned thereon, one or more anti-skid pads 57 which would be composed of a friction-like substance such as rubber or latex, which would prevent the movement of the keyboard which would be positioned thereon. Palm rest 16 is illustrated with respect no its relationship to support surface 24.

In the embodiment disclosed and illustrated in FIG. 3, keyboard support surface 24 which provides support for the computer keyboard may also be equipped with one or more anti-skid pads 62 which would be composed of a friction-like substance such as rubber or latex and which would prevent the movement of the keyboard which would be positioned thereon, during operation. Additionally, palm rest 16, as illustrated in FIG. 3, is secured to keyboard support platform 14 by means of threaded fasteners extending upwardly from the underside of keyboard support platform 14 and engaging threaded receiving slots (not shown) on the underside of palm rest 16. The relationship between the height of palm rest 16 and the keyboard will be addressed with respect to illustrations following hereafter.

The ancillary utilities associated with the keyboard support platform 14 are also illustrated in FIG. 3. These ancillary utilities which include document holder 18 and mouse pad 20 may be selectively employed with keyboard support platform 14 by means of utility plate 80. Utility plate 80 would be generally planer having a depending peripheral wall 82 and an extension tongue 84. Extension tongue 84 would be engageable between receiving slot 32 and the top of the table top or desk and secured by fastener 36 to maintain utility platform 80 in position on desk or table top 12 and in alignment with monitor 10.

Utility platform 80 cooperates with mouse pad 20 through the interlocking of peripheral wall 82 of utility platform 80 with edge flange 86 of mouse platform 85 which supports mouse pad 20. Mouse platform 85 is constructed with two edge flanges 86 in order that the operator may position the mouse platform 85 on either the right-hand side or left-hand side of monitor 10 and utility plate 80, depending upon the user's preference.

Document holder 18 would be secured to utility platform 80 in a similar manner, on the opposing side from mouse platform 85. Document holder 18 would be comprised of a planer arcuate base 90 having interlocking flanges 92 at the ends thereof for selective engagement with utility platform 80 and its peripheral wall 82. There would be disposed on arcuate planer base 90, an arcuate slot 91 for slidable receipt of fastening means 94 which would secure vertical support post 96 in perpendicular relationship with arcuate base 90 and would permit vertical support post 96 to be positioned in slidable relationship and pivotal relationship with arcuate support base 90 along arcuate slot 91. Vertical support post 96 would support document holder plate 98 in a vertical relationship which would allow support ribs 100 formed on the rear side of document support plate 98 to slidably engage a height adjustment slot 102 in vertical support post 96 to allow the operator or user to adjust document support plate 98 upwardly or downwardly on vertical support post 96 in order to achieve the proper eye contact angle with the document being transposed into the computer. Document holder 18 thus permits the user to move the document in an arcuate and pivotal fashion to obtain the optimum horizontal angle for viewing the document and also to move the document in a vertical fashion to obtain the optimum vertical plane for viewing the document. Document support plate 98 may also be equipped with a document retainer and line guide 104 slidably adjustable along the lateral edges of document support plate 98. The design of arcuate base plate 90 for document holder 18 and mouse platform 85 are such that they are interchangeable from the right hand to the left-hand side of the utility plate 80 depending upon the user's preference.

In operation, the operator therefore has two adjustments available with respect to keyboard support platform 14 as illustrated in FIG. 3, for obtaining a comfortable, posture-correct position in front of the keyboard and computer monitor with the simultaneous elimination of fatigue and stress points. These two adjustments are the height adjustment of keyboard support platform 14 by means of adjustment 50 and the angular tilt of keyboard support platform 14 by means of tilt control lever 42 in cooperation with stationary member 26 and movable member 28 of bracket 22. In addition to these two (2) adjustments with respect to the keyboard support platform 14 and the computer keyboard, the operator also has available the adjustments with respect to location of the mouse pad and the document holder and the vertical and horizontal relationship of the document holder with respect to the operator's height and line of sight.

Figure 4:
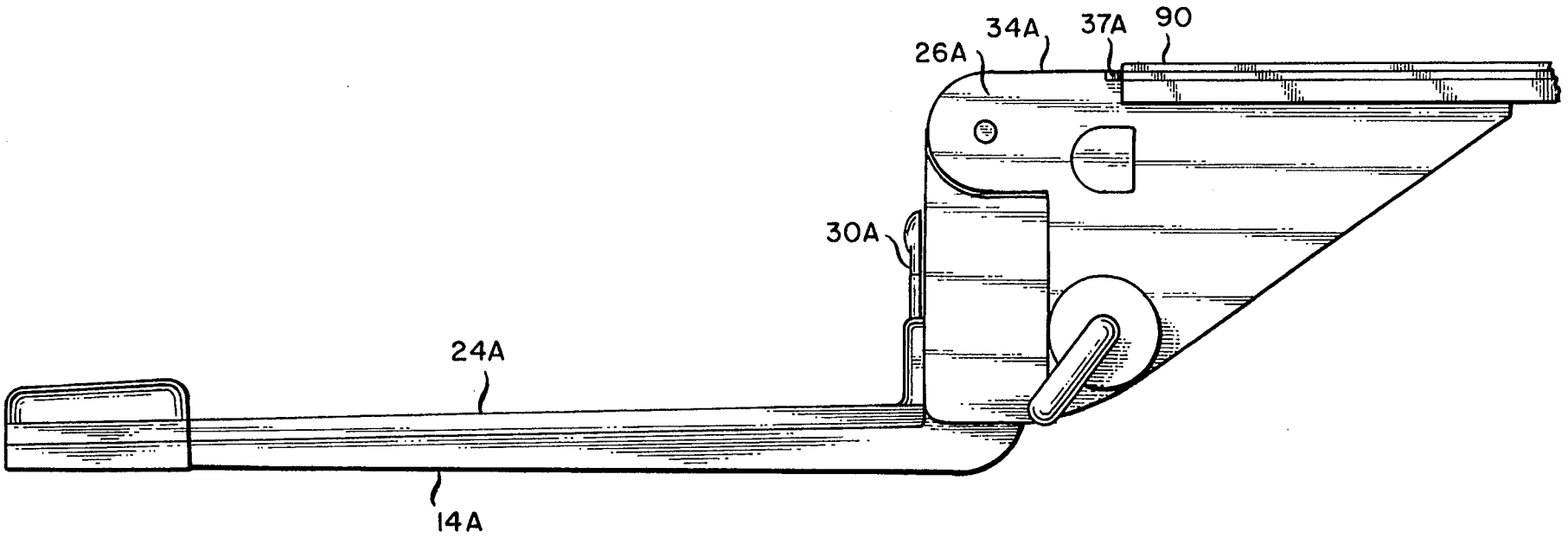
FIG. 4 is a side view of a second embodiment of the mounting method.

Referring to FIG. 4, there is illustrated a second embodiment of the keyboard positioning system. This embodiment is identical to that illustrated in FIG. 2 with the exception of the mounting method. The embodiment illustrated in FIG. 4 discloses a keyboard support platform 14A in which stationary member 26A no longer has a rectangular receiving slot 32 and fastener 36 to maintain its position on the computer workstation table or desk top. In this embodiment, stationary member 26A has positioned along its upper surface 34A, an extended flange 37A for engagement with a carriage rail 90 which is secured to the underside of the computer workstation table or desk top. This allows the keyboard support platform 14A to be withdrawn from under the computer workstation or table for use and pushed in a retracted mode beneath the computer workstation or table when not in use. The same angular tilt adjustments and height adjustments as described in FIGS. 2 and 3 with respect to embodiment 1 are still available to the operator with respect to the embodiment Illustrated in FIG. 4 and are achieved in the same manner. The ancillary utilities as described and illustrated in FIG. 3 are still available to the operator, however, when a keyboard positioning system as illustrated in FIG. 4, which is retractable beneath the table top or desk is utilized, then and in that event, utility plate 80 must be secured in an alternative fashion to the desk top or table top in order to provide support for document holder assembly 18 and mouse pad assembly 20.

FIG. 5 illustrates the advantages of Applicant's keyboard support system as it relates to the relief or reduction of carpal tunnel syndrome and to the benefits achieved with respect to the positioning of the ancillary utilities in relationship to Applicant's keyboard support system. In FIG. 5A, there is illustrated a side view of a human hand illustrating the differences between the neutral position as shown by the solid lines, and an extension position in which the hand is turned upwardly thereby creating tension on the wrist, and the flexion position in which the hand is tilted downwardly, again causing tension in the individual's wrist. The desirable position for maintenance of the hand when utilizing computer keyboards, is that of the neutral position. This prevents undue pressure and tension at the wrist which can lead to carpal tunnel syndrome and other maladies. FIG. 5B illustrates the position of the user with respect to Applicant's keyboard support system. The wrist and hand is maintained in a neutral position as a result of the angular tilt and height of the keyboard as discussed previously. In addition, the palm rest 16 is positioned to a conforming height which is substantially equal to the front edge of the computer keyboard. This permits the user to rest the palm of the hand on the palm rest with the fingers extended over the keyboard. The positioning results in a neutral position between the hand and wrist of the user. This position is medically desirable to prevent the onset of carpal tunnel syndrome or to lessen its effects in individuals or users who have already experienced the problem. This position also provides for greater comfort and relaxation of the user or operator as compared to those positions disclosed in FIG. 6 which represent operating standards presently in existence or makeshift attempts to relieve the problem. FIG. 6A illustrates the user's wrist and hand in an extension position. Similarly, FIG. 6B also represents and illustrates the user or operator's hand in an extension position contributing to the tension on the wrist. FIG. 6C illustrates an attempt to relieve the tension on the user or operator's wrist by tilting the keyboard downwardly. However, it can be readily seen that this results in a flexion of the user or operator's wrist which also places tension on the user or operator's wrist. The position as shown in FIG. 5B, which is achieved as a result of the angular tilt and height adjustments available through Applicant's structure, allows the user or operator to obtain a neutral wrist position.

This neutral wrist position achieved by Applicant's keyboard support system 14 further enhances the productivity of the user or operator and relieves tension and fatigue when coupled with the auxiliary utilities of Applicant's system as illustrated in FIG. 5C which illustrates these utilities being positioned in cooperative relationship with respect to the keyboard support system to allow for posture-correct positioning of the user or operator, together with the user or operator's ability to position the document support holder 18 within an angularly minimal line of sight in relationship to the computer monitor. The overall system therefore provides for a relaxed and tension-free position environment, yet still provides the user or operator access to all utilities necessary in the performance of their tasks.

It will be recognized by those skilled in the art that the apparatus has been described in connection with the exemplary embodiments thereof and it will be understood that many modifications will be apparent to those of ordinary skill in the art and this application is intended no cover any adaptations or variations thereof.

Therefore, it is manifestly intended that the invention be only limited by the claims and equivalents thereof.

What is claimed is:

1. An adjustable ergonomically-designed support assembly for support of a keyboard of the type associated with computers, the assembly comprising in combination:

a securing means engageable with a desk or counter top, said desk or table top supportive of a video monitor:

a support bracket attached to said securing means, said support bracket comprised of a fixed member depending from said securing means and a movable member secured to said fixed member and angularly positionable with respect to said fixed member;

an angular adjustment means cooperative with said fixed member and said movable member to selectively fix the angular relationship between said fixed member and said movable member, said angular adjustment means comprising a compression member selectively positioned from a locked to an unlocked position permitting the angular adjustment between said fixed member and said movable member;

a platform member slidably secured to said movable member in adjustable and vertical relationship to said movable member, said platform member slidably adjustable in height with respect to said movable member, said height adjustment means comprising a compression member engaged on a facing plate of said platform means, said compression member passing through said facing plate and engaging said movable member by means of a vertically-disposed channel aperture centrally disposed on said movable member thereby permitting vertical disposition of said platform means relative to said movable member;

a height adjustment means for selectively adjusting the height of said platform means;

a palm rest support secured to said platform means.

2. A keyboard support assembly in accordance with claim 1 wherein said palm rest contains a carbon impregnated conductor to restrict electrostatic discharges and low field discharges from the operator's body.

3. A keyboard support assembly in accordance with claim 1 said securing means engageable with said edge of said table top or desk simultaneously engages a utility plate positioned on said table top or said desk, said utility plate having a peripheral edge wall, said peripheral edge wall cooperatively engageable with a mouse pad and document holder so as to position said mouse pad and said document holder on selected lateral sides of said utility plate.

4. A keyboard support assembly in accordance with claim 3 wherein said document holder comprises an arcuate planer base having an engageable flange positioned at each end, said arcuate planer base having an arcuate slot formed in the surface thereof for receipt of a securing means for slidably rotating a supporting post in vertical, perpendicular relationship with said arcuate base, said support post having slidably secured thereto, in vertical relationship therewith, a document holder for receipt and securing of documents.

5. A keyboard support assembly in accordance with claim 3 wherein said mouse pad comprises a base having engageable flanges positioned on the lateral edges thereof for selective engagement with said utility plate, said mouse pad having a receptacle area for receipt of a mouse engaging surface.

6. A keyboard support assembly in accordance with claim 3 wherein said document holder and said mouse pad are interchangeable with respect to the lateral sides of said utility plate.

* * * * *